United States Patent [19]

Sugimoto et al.

[11] Patent Number: 4,933,724

[45] Date of Patent: Jun. 12, 1990

[54] FIXING DEVICE FOR ELECTROPHOTOGRAPHY

[75] Inventors: Yuji Sugimoto; Masaru Tsuji, both of Nara, Japan

[73] Assignee: Sharp Kabushiki Kaisha, Osaka, Japan

[21] Appl. No.: 342,702

[22] Filed: Apr. 24, 1989

Related U.S. Application Data

[63] Continuation of Ser. No. 240,398, Aug. 29, 1988, abandoned, which is a continuation of Ser. No. 131,261, Dec. 9, 1987, abandoned, which is a continuation of Ser. No. 928,971, Nov. 10, 1986, abandoned.

[30] Foreign Application Priority Data

Nov. 13, 1985 [JP] Japan ..... 60-176551[U]

[51] Int. Cl.[5] ..... G03G 15/00

[52] U.S. Cl. ..... 355/289; 355/285; 355/290; 219/216

[58] Field of Search ..... 355/3 FU, 282, 285, 355/289, 290, 315; 219/216

[56] References Cited

U.S. PATENT DOCUMENTS

| | | | |
|---|---|---|---|
| 3,268,351 | 8/1966 | Van Dorn | 355/3 FU |
| 3,690,176 | 9/1972 | Connolly et al. | 355/3 FU |
| 3,968,343 | 7/1976 | Guran | 219/216 |
| 4,309,591 | 1/1982 | Kanoto et al. | 219/216 |
| 4,329,565 | 5/1982 | Namiki | 355/3 FU |
| 4,348,579 | 9/1982 | Namba | 219/216 |
| 4,514,486 | 4/1985 | Shirose et al. | 355/3 FU |
| 4,572,648 | 2/1986 | Toriumi et al. | 355/315 X |
| 4,588,281 | 5/1986 | Elter | 355/3 FU |
| 4,627,813 | 12/1986 | Sasaki | 355/3 FU |

FOREIGN PATENT DOCUMENTS

| | | | |
|---|---|---|---|
| 57-63570 | 4/1982 | Japan | 355/289 |
| 151683 | 8/1985 | Japan | 355/3 FU |
| 62-231978 | 10/1987 | Japan | 355/206 |

*Primary Examiner*—R. L. Moses
*Assistant Examiner*—Ed Pipala
*Attorney, Agent, or Firm*—Flehr, Hohbach, Test, Albritton & Herbert

[57] ABSTRACT

A fixing device for electrophotography has a heating roller and a compression roller compressed against each other. Copy paper with toner image on its surface is passed inbetween to have the image fixed. The heating roller is hollow and contains a heater inside. To control the heat output of the heater, a temperature detector is positioned on the surface of the heating roller near the edge of the paper passing between the rollers where no toner image is formed. The wall thickness of the heating roller is reduced to about 0.8–1.5 mm for improved heat distribution characteristics.

5 Claims, 3 Drawing Sheets

FIXING DEVICE FOR ELECTROPHOTOGRAPHY

This is a continuation of Ser. No. 07/240,398 filed Aug. 29, 1988, abandoned, which is a continuation of Ser. No. 07/131,261 filed Dec. 9, 1987, abandoned, which is a continuation of Ser. No. 06/928,971 filed Nov. 10, 1986, abandoned.

BACKGROUND OF THE INVENTION

This invention relates to a fixing device for fixing toner images in electrophotography and more particularly to such a fixing device characterized by the position on its heating roller where a temperature detector is disposed.

The fixing device for an electrophotographic copying machine and the like typically comprises a heating roller which is made of metal and is heated to a temperature of about 200° C. and a compression roller which is disposed opposite to the heating roller and, when in operation, is compressed against it and follows its motion. The fixing process is effected with these rollers compressed against each other and rotating together, and a sheet of copy paper with a toner image transferred on its surface passes between these rollers. As the paper passes between the rollers, the toner is melted by heat and the image becomes fixed by the pressure of the rollers.

The heating roller is a hollow cylinder and holds a heater lamp at its center section. In addition, a temperature detector for the heater control such as a thermister is disposed in contact with the surface of the heating roller to detect its temperature. In order to maintain the heating roller at an appropriate temperature level for the fixing process, the power delivered to the heater lamp is controlled according to the output from this temperature detector.

In FIGS. 3A and 3B, a previously designed fixing device is illustrated with a heating roller 10, a compression roller 20 compressed against it, and a heater lamp 3 at the center of the heating roller 10. FIG. 3C shows the temperature distribution on the surface of the heating roller 10 by the operation of the heater lamp 3. It shows that the surface temperature is slightly higher near the ends and flat near the center, and it is because the rollers are intentionally so designed in order to compensate for the temperature drop at these places caused by the heat loss through the bearings for the heating roller 10. Since the thermal resistance of the roller housing is relatively high, however, the temperature distribution on the surface of the heating roller 10 does not always become flat, depending on the number of sheets of paper which pass through per unit time. FIG. 3C represents such a situation where temperature is relatively higher at the end sections. In order to be able to detect an average fixing temperature even if there is some such distortion in the temperature distribution, the temperature detector is disposed on the heating roller at a point which may be expected to be nearly in the middle of the temperature distribution. Because of the contact with the temperature detector, however, the surface of the heating roller sometimes becomes scratched and this may adversely affect the fixed image. In order to eliminate such a problem, it may be considered preferable to put the temperature detector at an end section of the heating roller but a representative value of the surface temperature cannot be detected at such a position, and it becomes difficult to accurately control the temperature of the heating roller.

SUMMARY OF THE INVENTION

It is an object of the present invention to provide a fixing device with which the surface temperature of its heating roller can be accurately detected without adversely affecting the quality of the image fixed on the paper passing therethrough even if the heating roller becomes scratched where the temperature detector is in contact therewith.

The above and other objects of the present invention are achieved by providing a fixing device of the type having two rollers, at least one of them being hollow and enclosing a heater at its center section, and the other roller being compressed against it and rotated with it, and passing therebetween a sheet of copy paper with a toner image. According to the present invention, the wall of the roller containing the heater is made thinner and a temperature detector for controlling the operation of the heater is placed in contact with the surface of this roller in the neighborhood of a side edge of the paper passing through these rollers where toner image is not formed.

With the device so structured, even if the surface of the heating roller becomes scratched because a temperature detector is in contact, the fixed image is not affected because it is near the side section of the paper where toner image is not formed. Since the wall thickness of the heating roller is thinner, furthermore, the thermal resistance of the roller surface is reduced. As a result, the device has improved thermal response characteristics and the temperature distribution on the roller surface can be made flat over a wider range by properly designing the heat distribution characteristics of the heater such as a heater lamp. Thus, the full surface temperature of the heating roller can be detected even though the detector is set near an end section of the roller and the surface temperature of the heating roller can be maintained at a desired level.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DESCRIPTION OF A PREFERRED EMBODIMENT

Figure 1A:
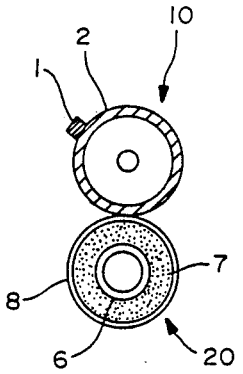
FIGS. 1A, 1B and 1C show the structure of a fixing device according to an embodiment of the present invention and its characteristics, FIG. 1A being its side sectional view, FIG. 1B being its frontal sectional view, and FIG. 1C being a graph showing the surface temperature distribution of the roller shown in FIGS. 1A and 1B.
Figure 1B:
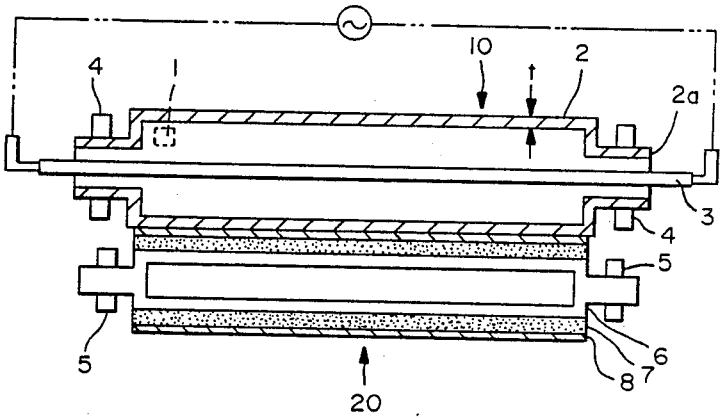

FIGS. 1A and 1B show the structure of a fixing device according to an embodiment of the present invention and its characteristics. Numeral 10 indicates a heating roller composed of a hollow aluminum housing 2 with reduced thickness about 0.8 to 1.5 mm and thermal conductivity about 0.53 cal/cm·sec·deg and a heater lamp 3 disposed axially. Its axis is supported by ball bearings 4 and rotated by a driving means (not shown). Numeral 20 indicates a compression roller with a silicone rubber roller 7 around its central shaft 6. A tubular layer 8 of ethylene tetrafluoride resin is formed on its surface. This roller is also rotatably supported by a pair of ball bearings 5.

Figure 1C:
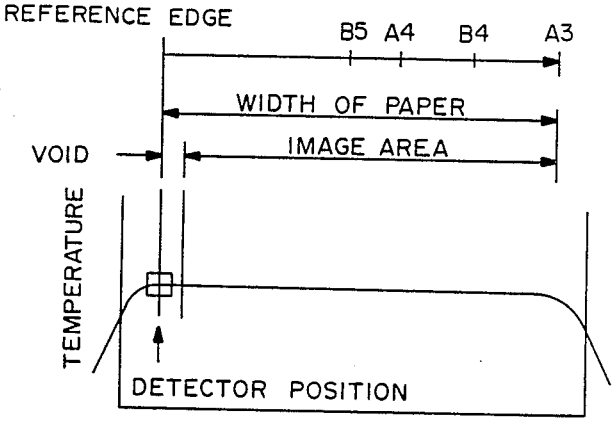

FIG. 1C shows the distribution characteristics of the surface temperature of the heating roller 10. Since the roller's thermal response characteristics are improved by reducing the wall thickness t of the heating roller to the aforementioned range, the temperature drop caused by the heat loss at the end axis sections can be compensated by properly setting the heating characteristics of the heater lamp 3. As a result, a uniform temperature distribution can be attained over a wide range and, although the temperature detector is positioned in contact at a side section external to the image area (where a toner image is formed on copy paper which passes through the rollers), it can detect the average temperature which is representative of the overall surface temperature of the heating roller. With reference to FIG. 1C, the "void section" indicates the section at the edge of copy paper where no toner image is formed. Such a void section comes about, for example, in the case of a copying machine designed to form a film at the edge of its photosensitive drum such that copy paper can be forcibly removed from its surface.

Figure 2B:
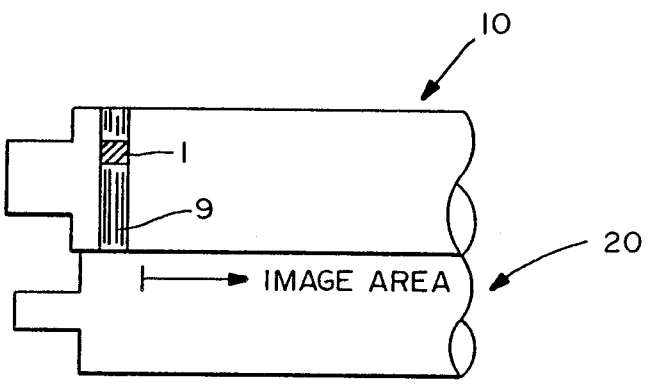
FIGS. 2A and 2B show how a temperature detector is attached on the surface of a heating roller according to the present invention, FIG. 2A being a side view of the roller and FIG. 2B being its front view.
Figure 2A:
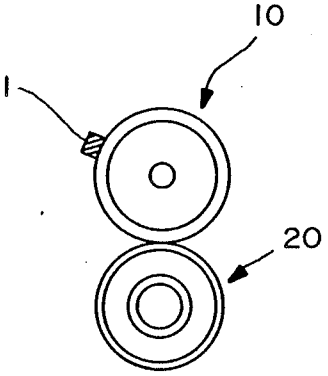
Figure 3A:
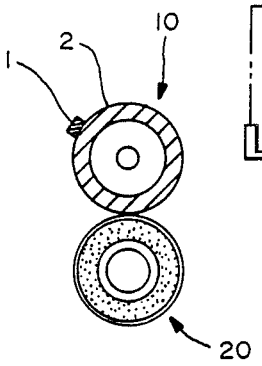
FIG.—3A (PRIOR ART)
FIGS. 3A, 3B and 3C show the structure of a previously considered fixing device FIG. 3A being its side sectional view, FIG. 3B being its front sectional view, and FIG. 3C being a graph showing the surface temperature distribution on the roller shown in FIGS. 3A and 3B.
Figure 3B:
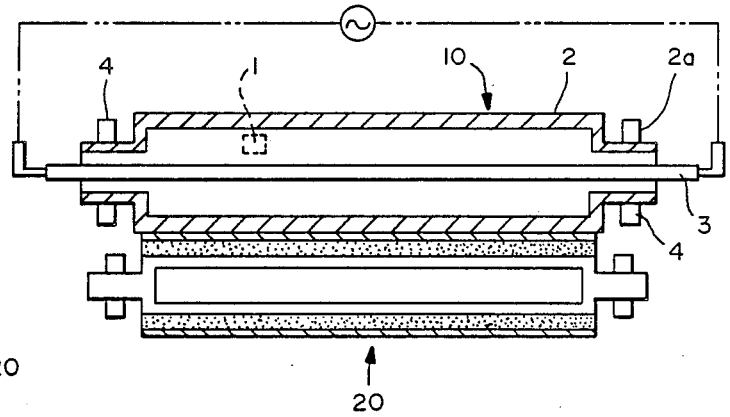
FIG.—3B (PRIOR ART)
Figure 3C:
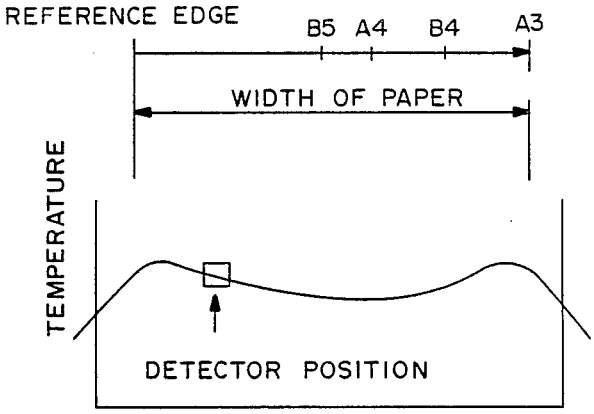
FIG.—3C (PRIOR ART)

FIGS. 2A and 2B show how a temperature detector 1 is positioned in contact with the heating roller. The detector 1 is for controlling the heater and serves to detect the temperature of the section where it is attached. The detector 1 is about 10 mm angle, having a thermistor buried in the surface part of sponge-like foam silicone with a heat-resisting tape applied on its surface. The surface of the heating roller tends to develop scratches 9 because of its contact with this heat-resisting tape but they do not affect the fixed image on the paper because the scratched areas correspond to where no toner image is formed on the copy paper which passes between the rollers.

There are copiers which cause copy paper to naturally fall off from the photosensitive drum by means of an erase charger. With such copiers, there are no void sections, and toner images are formed to the edge of the paper. Even in such situations, a temperature detector may be positioned near the paper edge external to the range where the paper is passed, and the scratches and the like made on the roller surface can be prevented from affecting the fixed images.

The foregoing description of a preferred embodiment of the invention has been presented for purposes of illustration and description. It is not intended to be exhaustive or to limit the invention to the precise form disclosed, and many modifications and variations are possible in light of the above teaching. Such modifications and variations which may be apparent to a person skilled in the art are intended to be included within the scope of this invention.

What is claimed is:

1. A fixing device of an electrophotographic image forming apparatus which includes a photosensitive drum, said fixing device comprising a first roller which is hollow and contains a heater at its center section, a second roller which is in contact and rotatable with said first roller, said rollers serving to pass a copy paper sheet therebetween to fix toner images thereon, said copy paper sheet having thereon a void section where no toner image is formed, and a temperature detector which controls said heater, said temperature detector being disposed in contact with said first roller at a position on the surface thereon corresponding to said void section of said copy paper sheet passing between said rollers.

2. The fixing device of claim 1 wherein said first roller comprises an aluminum cylinder of thermal conductivity about 0.53 cal/cm·sec·deg.

3. The fixing device of claim 1 wherein said first roller comprises a hollow aluminum housing with thickness about 0.8 to 1.5 mm.

4. The fixing device of claim 1 wherein said second roller includes a central shaft, a silicone rubber roller around said central shaft, and a tubular layer of ethylene tetrafluoride resin formed on said silicone rubber roller.

5. The fixing device of claim 1 wherein said temperature detector includes a thermister.

* * * * *